US006548945B1

(12) United States Patent
Tamura

(10) Patent No.: US 6,548,945 B1
(45) Date of Patent: Apr. 15, 2003

(54) SPARK PLUG AND METHOD OF MANUFACTURING THE SAME

(75) Inventor: Masayuki Tamura, Anjo (JP)

(73) Assignee: Denso Corporation (JP)

( * ) Notice: Subject to any disclaimer, the term of this patent is extended or adjusted under 35 U.S.C. 154(b) by 131 days.

(21) Appl. No.: 09/692,140

(22) Filed: Oct. 20, 2000

(30) Foreign Application Priority Data

Oct. 21, 1999 (JP) ..... 11-300208

(51) Int. Cl.[7] ..... H01T 13/20
(52) U.S. Cl. ..... 313/141; 313/143; 445/7
(58) Field of Search ..... 313/141, 143; 123/169 A; 445/7

(56) References Cited

U.S. PATENT DOCUMENTS 5,088,311 A 2/1992 Inoue
5,581,145 A * 12/1996 Kato et al. ..... 313/141

FOREIGN PATENT DOCUMENTS

JP 59-130391 * 9/1984
JP 60-133592 * 9/1985
JP 2000-48930 * 2/2000

* cited by examiner

*Primary Examiner*—Robert H. Kim
*Assistant Examiner*—Elizabeth Gemmell
(74) *Attorney, Agent, or Firm*—Nixon & Vanderhye PC

(57) ABSTRACT

A spark plug has a tubular fitting which is assembled with a center electrode, a ground electrode and an insulator. The fitting has a reach length of at least 12 mm for use in high output-type engines. The fitting is formed with a thread part and a taper part so that the fitting is thread engaged with an engine head and seals a combustion chamber from an outside by a contact between the taper part and a seat surface of the engine head. The fitting is made by cold-forging a low carbon steel to provide the taper surface of a surface roughness of less than 10 $\mu$m and a column part. The column part is machine-cut to provide the thread part thereon. The deflection between the axes of the thread part and the taper part is limited to be less than 0.15 mm.

20 Claims, 2 Drawing Sheets

SPARK PLUG AND METHOD OF MANUFACTURING THE SAME

CROSS REFERENCE TO RELATED APPLICATION

This application is based on and incorporates herein by reference Japanese Patent Application No. 11-300208 filed Oct. 21, 1999.

BACKGROUND OF THE INVENTION

The present invention relates to a spark plug that is inserted into a combustion chamber of an engine, and suitable for use in an engine that has a thick engine head for a higher engine output.

In conventional spark plugs, as shown in FIG. 3, a cylindrical insulator 301 surrounding a center electrode 305 is held inside a metallic fitting 303 in such a manner that one end 302 of the insulator 301 protrudes from one end 304 of the fitting 303. A ground electrode 307 is fixed to the fitting 303 so that the ground electrode 307 faces the top end of the center electrode 305 protruding from the insulator 301 through a discharge gap 308. This spark plug is threaded into a thread hole 310 formed in an engine head 309 that defines a combustion chamber 320 therein.

The fitting 303 is formed, on its outer peripheral surface, with a thread part 311 and a taper part 312 from the side of the end 304. The thread part 311 is engaged with the thread hole 310 by turning the plug. The taper part 312 has a diameter gradually decreasing toward the thread part 311. The taper part 312 contacts a taper surface 313 formed on the thread hole 310 to restrict leakage of gas from the combustion chamber 320.

The fitting 303 is produced by a cold-forging and then machine-cut to form the taper part 312 and the thread part 311 in shape. The machine-cutting tends to produce traces of a cutting tool (tool mark) on the taper part surface, resulting in a high surface roughness. Further, the machine-cutting tends to produce deflection of longitudinal axes between the thread part 311 and the taper part 312. As a result, sealing characteristics of the taper part 312 is lessened.

In high output-type engines, the engine head is made thicker to ensure more coolant flow for higher cooling efficiency. The fitting of the spark plug for such engines generally has a reach length RL of more than 12 mm. As known well in the art, the reach length is defined as a length from the end 304 of the fitting 303 to the point where the diameter of the taper part 312 is 14.8 mm. In the case of a spark plug having a longer reach length for high output type engines, it must have a sufficient sealing ability because the pressure in the combustion chamber 320 increases.

SUMMARY OF THE INVENTION

It is therefore an object of the present invention to provide a spark plug that can provide a sufficient sealing ability for use in high output-type engines.

According to the present invention, a spark plug comprises a center electrode, a ground electrode and a tubular fitting for engagement with an engine head. The fitting has a thread part and a taper part from one end thereof toward another end thereof. The fitting is formed by cold-forging a low carbon steel so that the taper part has its cold-forged surface roughness of less than about 10 $\mu$m. The fitting is machine-cut to provide the thread part which deflects less than about 0.15 mm from the taper part with respect to longitudinal axes. This fitting is suitably used for spark plugs for high output engines in which a reach length of the fitting is at least 12 mm.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
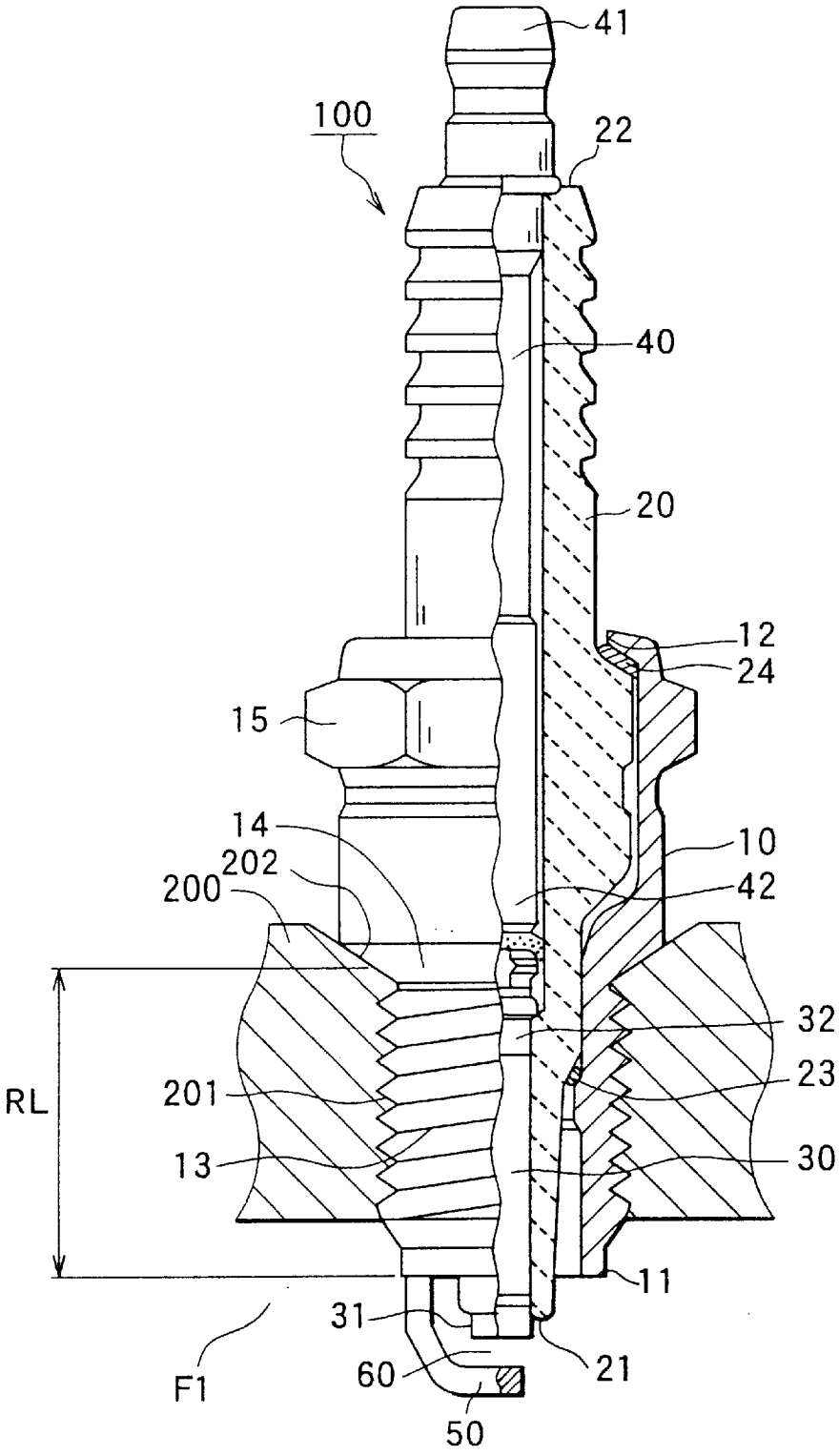
FIG. 1 is a front view showing, partly in section, a spark plug according to an embodiment of the present invention.

Referring first to FIG. 1, a spark plug 100 is threaded into a thread hole 201 formed in an engine head 200 that defines a part of combustion chamber F1. The spark plug 100 has a generally tubular fitting 10 made of a conductive steel material (for instance, low carbon steel). On the outer peripheral surface of the fitting 10, a thread part 13, a taper part 14 and a hexagonal nut part 15 are formed from one end 11 at the combustion chamber side to the other end 12. The plug 100 is fixedly inserted by engaging the thread part 13 with the thread part 201 while turning the hexagonal nut part 15 by a wrench or like tools.

The taper part 14 has a diameter that decreases gradually toward the thread part 13 in the axial direction. The taper part 14 tightly contacts a tapered seat surface 202 formed on the thread hole 201, thus restricting leakage of gas from the combustion chamber F1. The fitting 10 has a reach length RL of more than 12 mm. The reach length RL is defined as an axial length from the end 11 to a point where the diameter of the taper part 14 is 14.8 mm.

The fitting 10 tightly holds therein a cylindrical insulator 20 made of alumina ceramics such as $AL_2O_3$. One end 21 and the other end 22 of the insulator 20 are exposed from the one end 11 and the other end 12 of the fitting 10, respectively. Packings 23 and 24 are interposed between the insulator 20 and the fitting 10 to seal a space between the insulator 20 and the fitting 10. Specifically, the packing 23 is located near the end 11 of the fitting 10, and the packing 24 is located right at the other end 12 of the fitting 10.

The insulator 20 fixedly holds therein a center electrode 30 and a stem 40 that are connected to each other. One end 31 of the center electrode 30 protrudes from the end 21 of the insulator 20, and one end 41 of the stem 40 protrudes from the other end 22 of the insulator 20. Thus, the center electrode 30 is insulated from the fitting 10 by the insulator 20 and protrudes into the combustion chamber F1.

A ground electrode 50 is fixed to the end 11 of the fitting 10 by welding or the like. The ground electrode 50 is formed in the L-shape and faces the end surface of the center electrode 30 through a discharge gap 60. The spark plug 100 thus generates a spark discharge to ignite air-fuel mixture in the combustion chamber F1 when a high discharge voltage is applied between the center electrode 31 and the ground electrode 50.

In this embodiment, the fitting 10 is produced by a cold-forging into a shape that has the taper part 14 and a columnar part for the thread part 13. Machine-cutting is applied only to the columnar part to form the thread part 13. It is preferred that the fitting 10 is made of a carbon steel material which includes carbon in as low percentage as possible. No cutting trace is produced on the taper part surface, because the taper part 14 is not machine-cut. The deflection (lateral offset) of longitudinal axes of the taper part 14 and the thread part 13 is minimized, because the taper part 14 and the columnar part for the thread part 13 are produced by using the same die in the cold-forging process.

The surface roughness of the taper part 14 can be improved by lowering the surface roughness of the die used for the cold-forging so that the sealing ability of the taper part 14 and the seat surface 202 of the head 200 is increased. The taper part 14 is enabled to contact the seat surface 202 uniformly over an entire circumference of the taper part 14, because the axes of the thread part 13 and the taper part 14 are aligned in line with a least deflection (offset).

Figure 3:
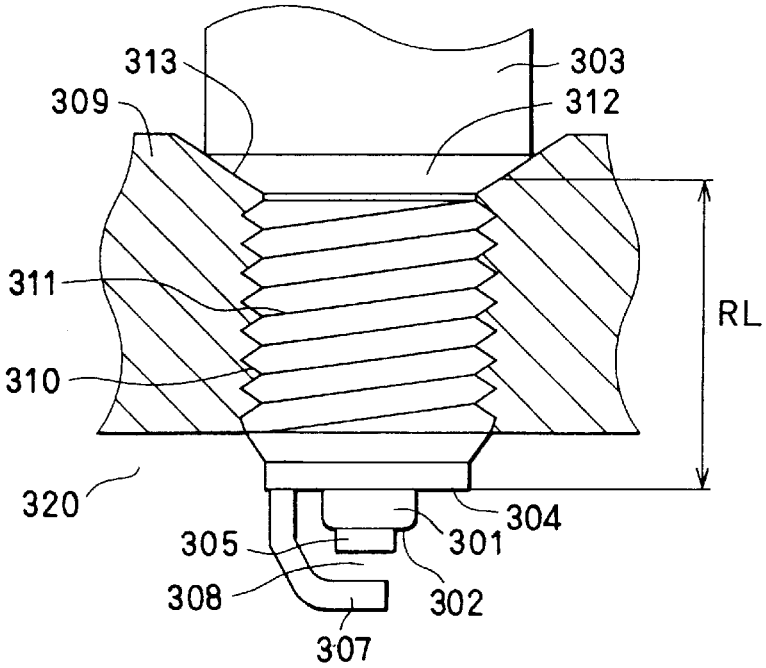
FIG. 3 PRIOR ART
FIG. 3 is a front view showing, partly in section, a part of a conventional spark plug.

The sealing ability of the taper part 14 formed by the cold-forging is set to have the following characteristics for spark plugs that have the reach length RL of 12 mm or more. That is, the amount of gas (air) leaking from the combustion chamber F1 out to outside through the taper part 14 should be less than 1 $cm^3$ per minute under a condition that the spark plug is mounted as shown in FIG. 1, the pressure of gas in the combustion chamber F1 is 1.96 Mpa (20 $kg/cm^2$) and the temperature at the taper part 14 is 200° C. This sealing ability cannot be attained by such conventional spark plugs as shown in FIG. 3.

Figure 2:
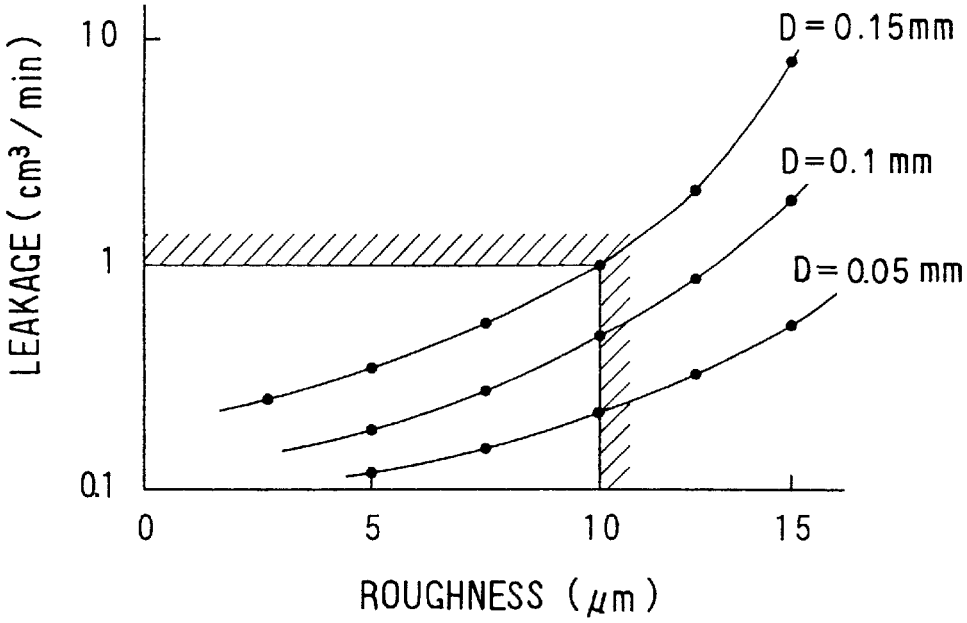
FIG. 2 is a graph showing a relationship among a surface roughness, a deflection amount and an air leakage amount.

The result of study on the sealing ability is shown in FIG. 2 in relation to the surface roughness of the taper part 14 and the deflection (D) of the axes of the thread part 13 and the taper part 14. The surface roughness is measured according to JIS B0651-1996 by using a needle tip end of 2 $\mu$m, that is, by using a surface roughness meter and defining the roughness according to a 10-point average method.

As understood from FIG. 2, the leakage of gas decreases as the surface roughness decreases. This is because lower roughness produces less friction between the taper part 14 and the seal surface 202 and enables the fitting 10 to be screwed into the thread hole 201 deeper thereby to increase the tightening force in the axial direction, when the fitting 10 is screwed into the thread hole 201. It is clear from FIG. 2 that the surface roughness should be less than 10 $\mu$m to restrict the leakage to be less than 1 $cm^3$/min.

As also understood from FIG. 2, the leakage of gas decreases as the deflection D decreases. This is because less deflection produces less local friction between the taper part 14 and the seat surface 202 and enables tightening of the fitting 10 deeper into the thread hole 201. It is clear from FIG. 2 that the leakage can be maintained to be less than 1 $cm^3$/min, as long as the deflection D is less than 0.15 mm if the roughness is less than 10 pm. The deflection, or lateral spacing between longitudinal axes, D is more preferably less than 0.1 mm.

The present invention should not be limited to the above embodiment, but may be modified in many other ways without departing from the spirit of the invention.

What is claimed is:

1. A spark plug for engines comprising:

a tubular fitting having a thread part and a taper part in that order on an outer surface of the tubular fitting, from one end thereof toward another end thereof and having a reach length of at least 12 mm, the thread part being for engagement with the engine, and the taper part being for sealing a combustion chamber from an outside by contacting the engine;

a center electrode held in and insulated from the tubular fitting with one end thereof protruding from the one end of the tubular fitting; and a ground electrode fixed to the tubular fitting and facing the one end of the center electrode through a discharge gap therebetween, wherein the taper part is formed into a tapered shape thereof by a cold-forging.

2. The spark plug as in claim 1, wherein the taper part has a surface roughness of less than about 10 $\mu$m.

3. The spark plug as in claim 2, wherein a lateral spacing between longitudinal axes of the taper part and the thread part is less than about 0.15 mm.

4. The spark plug as in claim 1, wherein a lateral spacing between longitudinal axes of the taper part and the thread part is less than about 0.15 mm.

5. The spark plug as in claim 1, wherein the taper part is not machine-cut after the cold-forging and the thread part is machine-cut after the cold forging.

6. The spark plug as in claim 1, wherein said taper part is disposed adjacent said thread part, and said taper part has a first outer diameter at a first end thereof adjacent said thread part generally corresponding to an outer diameter of said thread part, and has a tapered surface to a second end thereof which has a second outer diameter greater than said first outer diameter and greater than a maximum diameter of said thread part.

7. The spark plug as in claim 1, wherein the taper part has a tapered outer surface of gradually increasing diameter from a first diameter adjacent said thread part to a second diameter, larger than the first diameter, at an end thereof remote from said thread part, said second diameter being greater than a maximum diameter of said thread part.

8. A spark plug for engines comprising:

a tubular fitting having a thread part and a taper part in that order on an outer surface of the tubular fitting, from one end thereof toward another end thereof and having a reach length of at least 12 mm;

a center electrode held in and insulated from the tubular fitting with one end thereof protruding from the one end of the tubular fitting; and a ground electrode fixed to the tubular fitting and facing the one end of the center electrode through a discharge gap therebetween, wherein the taper part of the tubular fitting has a cold-forged surface roughness of less than about 10 $\mu$m.

9. The spark plug as in claim 8, wherein a lateral spacing between axes of the taper part and the thread part is less than about 0.15 mm.

10. The spark plug as in claim 9, wherein the lateral spacing between the axes of the taper part and the thread part is less than 0.1 mm.

11. The spark plug as in claim 8, wherein the taper part is not machine-cut after the cold-forging and the thread part is machine-cut after the cold forging.

12. The spark plug as in claim 8, wherein said taper part is disposed adjacent said thread part, and said taper part has a first outer diameter at a first end thereof adjacent said thread part generally corresponding to an outer diameter of said thread part, and has a tapered surface to a second end thereof which has a second outer diameter greater than said first outer diameter and greater than a maximum diameter of said thread part.

13. The spark plug as in claim 8, wherein said thread part is machine cut to define a threaded outer circumferential surface for engaging a thread hole of the engine so that when the thread part is engaged with the thread hole, a contact between the taper part and a seat surface of the thread hole seals the thread hole.

14. The spark plug as in claim 8, wherein the taper part has a tapered outer surface of gradually increasing diameter from a first diameter adjacent said thread part to a second diameter, larger than the first diameter, at an end thereof remote from said thread part, said second diameter being greater than a maximum diameter of said thread part.

15. A method of manufacturing a spark plug for an engine having a thread hole comprising:

cold-forging a low carbon steel into a shape of a tubular fitting having a taper part, which contacts the thread hole of the engine to seal a combustion chamber from an outside, and a column part, the taper part having a cold-forged surface roughness of less than about 10 $\mu$m; and assembling a center electrode and a ground electrode with the tubular fitting.

16. The method as in claim 15, further comprising:

machine-cutting only the column part to form a thread part thereon which is engageable with the thread hole of the engine.

17. The method as in claim 16, wherein a lateral spacing between longitudinal axes of the taper part and the thread part is less than about 0.15 mm.

18. The method as in claim 17, wherein the fitting is sized to have a reach length of about more than 12 mm from one end thereof to a point on the surface of the taper part where the diameter of the taper part is 14.8 mm.

19. The method as in claim 16, wherein said taper part is disposed adjacent said thread part, and said taper part has a first outer diameter at a first end thereof adjacent said thread part generally corresponding to an outer diameter of said thread part, and has a tapered surface to a second end thereof which has a second outer diameter greater than said first outer diameter and greater than a maximum diameter of said thread part.

20. The method as in claim 16, wherein the taper part has a tapered outer surface of gradually increasing diameter from a first diameter adjacent said thread part to a second diameter, larger than the first diameter, at an end thereof remote from said thread part, said second diameter being greater than a maximum diameter of said thread part.

* * * * *